US011213172B2

(12) United States Patent
Van Spengen

(10) Patent No.: US 11,213,172 B2
(45) **Date of Patent: *Jan. 4, 2022**

(54) DRAIN FIXTURE

(71) Applicant: NuWhirl Systems Corporation, Corona, CA (US)

(72) Inventor: Dale Van Spengen, Smith Falls (CA)

(73) Assignee: NuWhirl Systems Corporation, Corona, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/709,737

(22) Filed: Dec. 10, 2019

(65) Prior Publication Data

US 2020/0205618 A1 Jul. 2, 2020

Related U.S. Application Data

(63) Continuation of application No. 15/489,375, filed on Apr. 17, 2017, now Pat. No. 10,542,846.

(60) Provisional application No. 62/324,835, filed on Apr. 19, 2016.

(51) Int. Cl.

| | |
|---|---|
| ***A47K 3/00*** | (2006.01) |
| ***E03C 1/22*** | (2006.01) |
| ***E03C 1/24*** | (2006.01) |
| ***E03C 1/26*** | (2006.01) |

(52) U.S. Cl.

CPC ..... *A47K 3/00* (2013.01); *E03C 1/22* (2013.01); *E03C 1/24* (2013.01); *E03C 1/26* (2013.01)

(58) Field of Classification Search

CPC .... A47K 3/00; E03C 1/22; E03C 1/24; E03C 1/26; E03C 1/2304; E03C 1/232; F16L 47/30; F16L 47/28; F16L 47/32; F16L 41/021

USPC ..... 4/651, 680

See application file for complete search history.

(56) References Cited

U.S. PATENT DOCUMENTS

| | | | | | |
|---|---|---|---|---|---|
| 917,395 | A | | 4/1909 | Wise | |
| 938,102 | A | | 10/1909 | Wise | |
| 1,008,400 | A | * | 11/1911 | Wise | E03C 1/22 4/288 |
| 1,018,021 | A | | 2/1912 | Willetts | |
| 1,070,424 | A | * | 8/1913 | Danver | E03C 1/22 4/288 |
| 1,584,986 | A | * | 5/1926 | Fleming | E04D 13/0409 210/165 |
| 1,816,458 | A | * | 7/1931 | Zinkil | E03C 1/23 4/689 |
| 1,984,950 | A | * | 12/1934 | Steen | E03C 1/2304 4/689 |
| 2,085,876 | A | * | 7/1937 | Steen | E03C 1/2304 4/685 |
| 2,444,340 | A | | 6/1948 | Donahue | |
| 3,393,409 | A | * | 7/1968 | Politz | E03C 1/22 4/679 |
| 3,813,708 | A | * | 6/1974 | Hamburg | A47K 1/14 4/286 |

(Continued)

*Primary Examiner* — Benjamin R Shaw

(74) *Attorney, Agent, or Firm* — Knobbe Martens Olson & Bear, LLP

(57) ABSTRACT

This disclosure provides a drain fitting having a discharge portion comprising a chamber formed by walls extending between and around an inlet and an outlet, the inlet being wider than the outlet or having a greater cross-sectional area than the outlet and the walls having interior surfaces sloping inwardly between the inlet and outlet.

20 Claims, 4 Drawing Sheets

(56) References Cited

U.S. PATENT DOCUMENTS 4,207,632 A 6/1980 Savell, Jr. et al.
4,218,786 A 8/1980 Taglarino
4,594,739 A 6/1986 Watts et al.
4,669,131 A * 6/1987 Barlow ..... E03C 1/24 4/683
6,058,525 A * 5/2000 Paden ..... E03C 1/24 4/287
6,418,569 B1 * 7/2002 Knight ..... E03C 1/22 4/287
6,546,573 B1 4/2003 Ball
6,681,420 B1 * 1/2004 Ball ..... E03C 1/22 4/680
6,810,537 B1 * 11/2004 Barnes ..... E04H 4/1236 137/362
6,890,427 B2 * 5/2005 Self ..... E03C 1/20 210/163
8,438,807 B1 5/2013 Cornwall
8,713,724 B1 5/2014 Gottle et al.
9,157,220 B2 10/2015 Ball et al.
9,187,885 B2 11/2015 Schulze
9,896,827 B1 2/2018 Hsieh et al.
10,151,087 B1 * 12/2018 Wang ..... E03C 1/2304
10,542,846 B2 1/2020 Van Spengen et al.
2004/0034926 A1 2/2004 Ball
2004/0055084 A1 * 3/2004 Ball ..... E03C 1/244 4/680
2006/0075549 A1 4/2006 Witzleben
2008/0005835 A1 1/2008 Shipley et al.
2010/0037392 A1 * 2/2010 Ball ..... E03C 1/2304 4/683
2011/0000014 A1 * 1/2011 Ball ..... E03C 1/232 4/679
2012/0047646 A1 3/2012 Park
2013/0180045 A1 7/2013 Ball et al.
2014/0201900 A1 * 7/2014 Torres ..... A47K 3/006 4/556
2014/0289943 A1 10/2014 Myers, II
2014/0299555 A1 10/2014 Green
2015/0089736 A1 4/2015 Bird et al.
2015/0184367 A1 * 7/2015 Jin ..... E03C 1/22 4/689
2016/0177554 A1 * 6/2016 Yu ..... E03C 1/2304 4/685
2016/0374897 A1 * 12/2016 Carey ..... A47K 3/006 4/568
2018/0087248 A1 * 3/2018 Buchan ..... F16L 41/14

* cited by examiner

DRAIN FIXTURE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Field of the Invention

This disclosure is concerned with drain fittings and drain systems, which may be configured to optimize drain flow, particularly from baths and showers.

Description of the Related Art

A typical drain from a bath is 1½ inches in diameter, with the connection to waste, such as a sewer pipe, being the same diameter. This standard drain size limits the flow of water and therefore the draining of a bath. The rate of flow is further compromised by restrictions in the drain fitting, such as stopper systems and the like. Attempts to increase the drain size are limited by resistance to deviate from industry standards. More particularly, the reduction in diameter from a larger drain to a tail piece component that is 1½ inches in diameter poses various problems. This leads to connection designs that violate code requirements and provide less than optimal outflow, in view of the initial, larger size in the drain shoe that encourages a particular flow rate that then gets slowed by the reduction in size in the connection between the drain and the waste or sewer pipe. This problem has particular inconvenience for users of walk-in-baths, where the user has to wait for the bath to drain before the door in the walk-in-bath can be opened for exit.

Therefore, objects of this disclosure include connectors from a drain inlet to a waste or sewer pipe, which pipe has a diameter smaller than that of the drain inlet that, in use, meet local code requirements; and/or have improved flow characteristics over comparable such diameter reduction drains; and/or provide faster drain times for showers and baths than comparable such diameter reduction drains.

SUMMARY OF THE INVENTION

This disclosure provides a drain fitting having a discharge portion comprising a chamber formed by walls extending between and around an inlet and an outlet, the inlet being wider than the outlet or having a greater cross-sectional area than the outlet and the walls having interior surfaces sloping inwardly between the inlet and outlet.

The drain fitting can further comprise a connector portion having an outlet opening configured to be connected to a pipe for carrying water flowing through the drain fitting to a sewer system or elsewhere and walls forming a hollow body portion, which is in fluid communication with the outlet opening and the outlet of the chamber of the drain fitting. Conveniently, the walls of the chamber can merge with a wall or the walls of the body of the connector portion, for example around a hole in a wall of the body or by joining the walls of the body in a generally elbow shaped manner.

The chamber can have a shape that is generally that of a truncated cone.

The walls of the body portion of the connector portion can form a generally cylindrical shape.

This disclosure also provides a drain fitting or drain shoe comprising an inlet section having an opening and an outlet section having an opening, the inlet opening being larger than the outlet opening, walls extending around the inlet section and extending towards the outlet section, the walls having inner surfaces forming a generally conical section between the inlet section and the outlet section.

This drain fitting or drain shoe may further comprise a downstream section comprising an inlet in fluid communication with the outlet section and an outlet for connection to a sewer pipe or the like.

The drain fittings herein may have a central axis extending between the inlet/inlet section and the outlet/outlet section. The walls between the inlet/inlet section and the outlet/outlet section may be formed symmetrically around that axis.

The drain fitting herein may have a cable drain operating mechanism. For example, the drain inlet may have a fitting for receiving a pop-up drain filter and/or closure. The drain fitting may contain an actuator for opening and closing such a pop-up. Connected to the actuator may be a cable system for remote operation of a linkage mechanism for moving the actuator up and down. The mechanism may be located in the drain fitting or in a housing attached to of formed integrally with the drain fitting.

This disclosure also provides low profile drain fittings and drain shoes. These may be particularly suitable for use under showers or baths where space is limited. One way of achieving this where a pipe connector portion extends generally perpendicularly to the axis of the drain inlet is to minimize the length of the walls between that inlet and the walls that form the pipe connector portion.

Such fittings or drain shoes, as with others disclosed herein, can have interior walls and, optionally, exterior walls that converge or taper towards each other between the fitting or drain shoe inlet and outlet, more particularly about a central axis that extends through the drain inlet.

This disclosure also provides baths and showers incorporating the drain fittings and drain shoes disclosed herein. For example, this disclosure provides walk-in baths having the drain fittings and drain shoes disclosed herein to drain water from such baths.

This disclosure also provides a method of enhancing flow through a drain, particularly between a bath or shower and sewer pipe or the like, wherein the drain diameter in the shower or bath is larger than the diameter of the sewer pipe or the like, and in which the flow rate of water from the shower or bath is maximized, despite said reduction in size, by using a drain fitting or shoe described herein.

This disclosure provides drain fittings or drain shoes and systems containing them, such as drain kits and bath or shower installations that get as much water flowing into the drain tail piece as possible using an enlarged inlet to the drain fitting or drain shoe. The denominal diameter of the inlet to the drain fitting or drain shoe and therefore from the bath or shower is more than 1½ inches, for example, 2 inches, 2¾ inches, 2½ or 3 inches. The drain fittings and drain shoes of this disclosure are designed to satisfy the Universal Plumbing Code.

Getting as much water flowing into the drain tail piece as possible may be achieved by maximizing the size of the water inlet opening, which tends to negate the effect of structures causing flow restrictions, such as the support and mechanism for the pop up valve, and keeping the tailpiece unobstructed.

In connection with baths, the high flow characteristics of the drain fittings and drain shoes fill the overflow pipe as much as possible, which minimizes or eliminates air from becoming entrained in the water outflow, thereby providing a head or "tower" of water in the overflow pipe, which contributes to an increased static pressure the drives water into the sewer pipe or the like. With optimal enhanced drain flow, as per this disclosure, the height of the water tower in the overflow pipe may be almost to the level of the water in the bath.

This head of water, together with the water in the bath provides a gravity driven encouragement for water to flow efficiently out of the tailpiece, and into the sewer pipe or the like.

These systems may "flood" the drain tail pipe with full capacity gravity pressurized water. These systems typically minimize or substantially eliminate flow restrictions in the drain shoe or drain fitting.

This may be done in combination with opening up the bath water inlet channel in the drain shoes and drain fittings of this disclosure so that any physical restrictions such as support and the like are located in much larger opening for the bath water inlet into the drain shoe or drain fitting.

BRIEF DESCRIPTION OF THE DRAWINGS

Some preferred embodiments will now be more particularly described by reference to the accompanying drawings in which.

DETAILED DESCRIPTION OF THE PREFERRED EMBODIMENT

Figure 1:
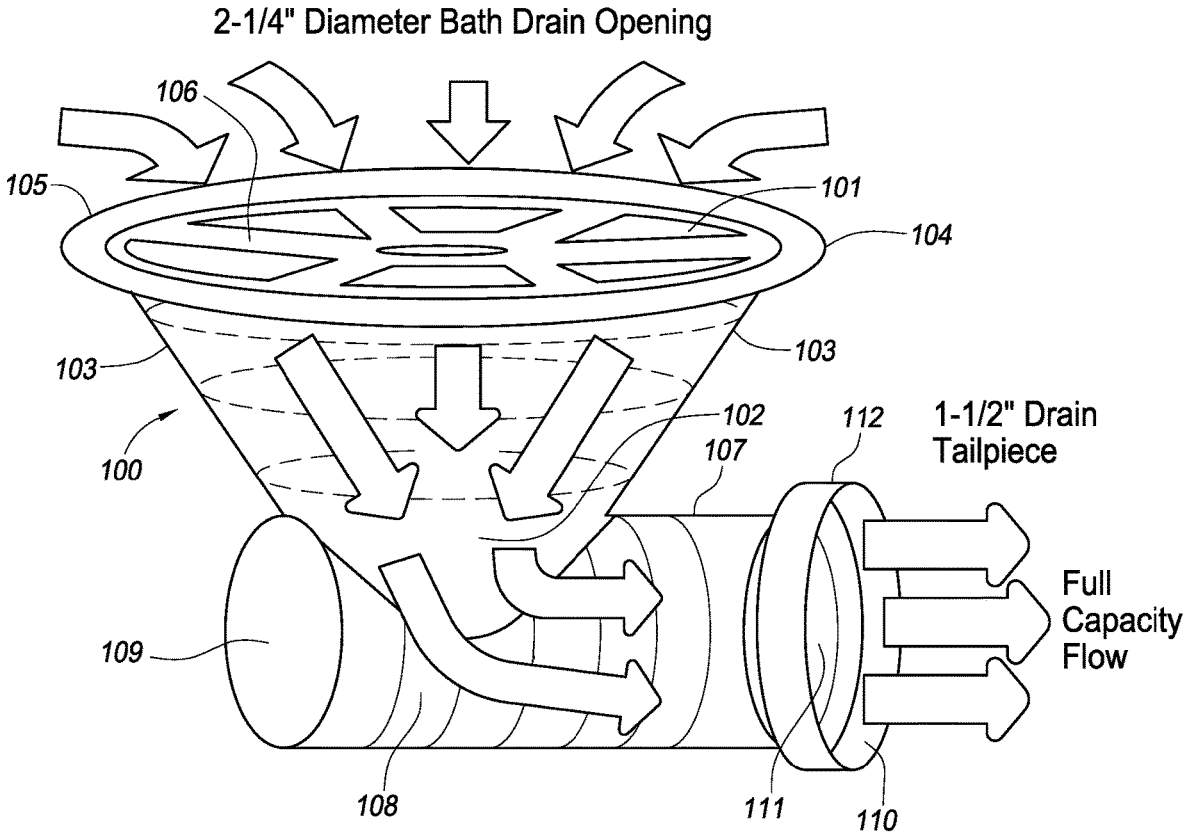
FIG. 1 is a schematic illustration of a drain fitting according to the invention.

Referring to FIG. 1, there is shown a drain fitting (100) comprising an inlet (101) and an outlet (102) having walls (103) there between. Inlet (101) typically has a circular periphery (104) and may have seated therein a waste plug assembly (105) with a strainer (106). Walls (103) slope gradually inwards from inlet (101) to outlet (102), preferably forming a generally truncated conical shape. Walls (103) merge into the walls (107) of a generally cylindrical short tube (108), typically having one end closed at (109) and the other end open at (101) having an outlet (111) to form a drain tail piece having a connector element (112) for attachment to a sewer or waste pipe (not shown).

Walls (103) function to gather water exiting a bath or shower or the like through a relatively large inlet (101) and, despite the reduction in flow area caused by the smaller cross-sectional area of tube (108), achieve full capacity flow from that tube.

Figure 2:
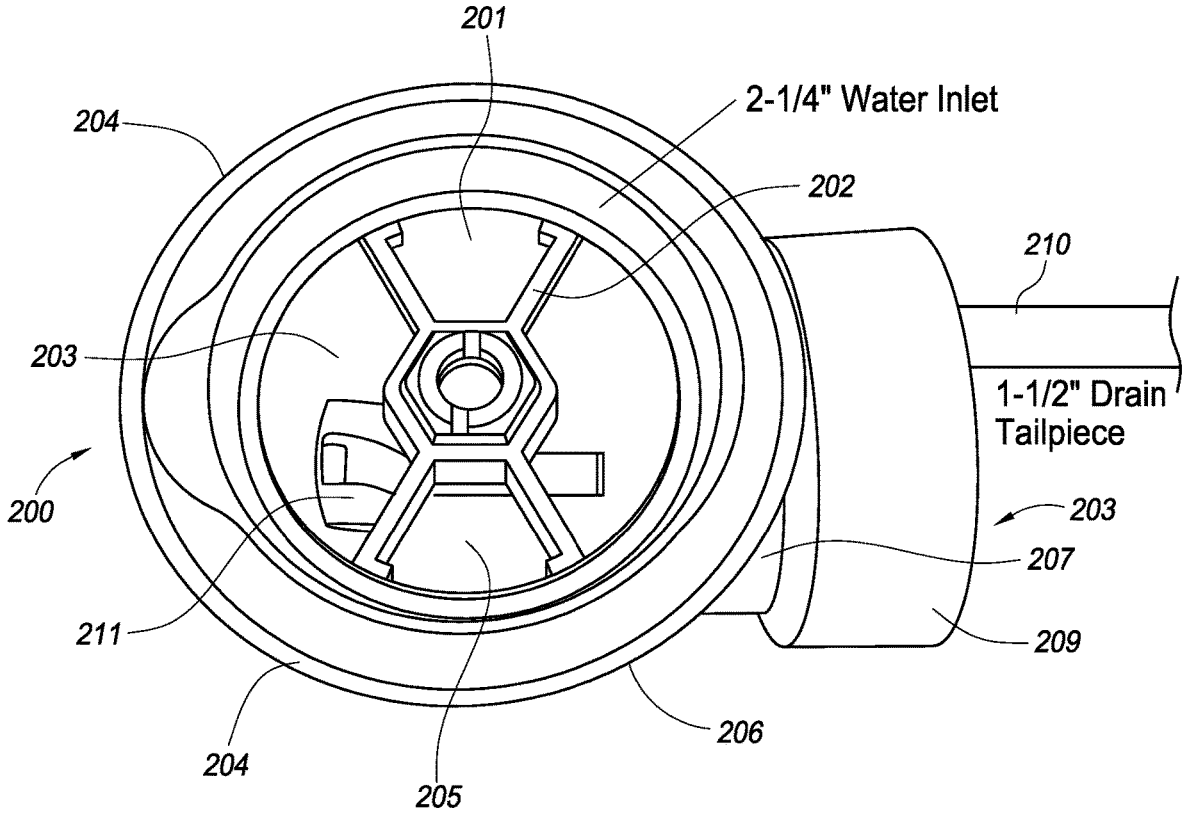
FIG. 2 is a top view of a drain fitting according to the invention.

Referring to FIG. 2, there is shown a drain fitting (200), according to this disclosure. Drain fitting (200) comprises an inlet (201) which is generally circular in cross section. Extending across the inlet (201) is a fitting (202) for receiving a drain closure (not shown).

Inlet (201) communicates with an internal chamber (203) formed by walls (204). As shown in FIG. 1, walls (204) converge or taper generally downwards towards outlet (205) to communicate with a tail piece fitting (206) comprising a cylindrical tube having an outlet (207) with an enlarged fitting (208) for connection to a sewer pipe.

A cable drain mechanism may be provided comprising a cable assembly (300) and an actuator (301) located at the bottom of chamber (203). In a conventional manner, cable assembly (210) operates actuator (211) to drive the closure upward and downward so as to open and close the water inlet.

Figure 3:
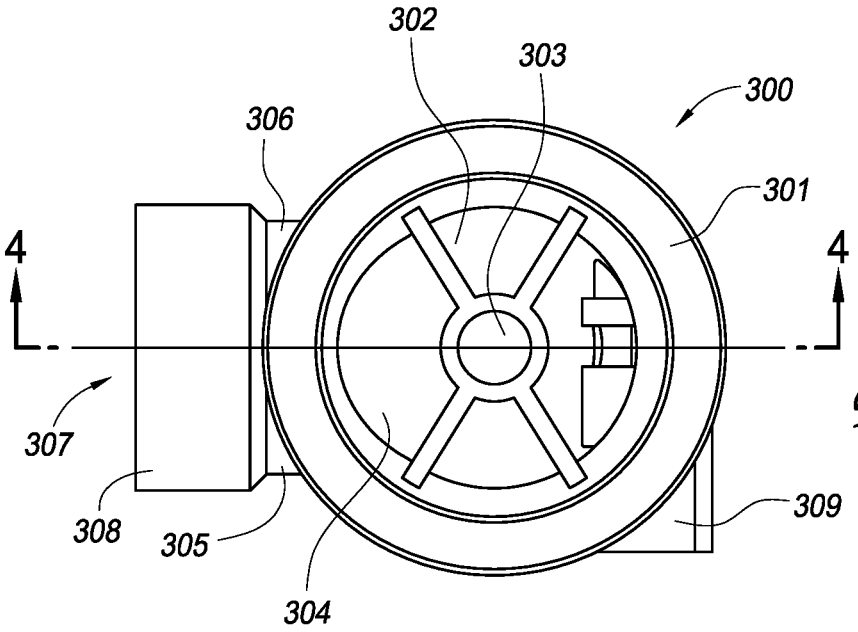
FIG. 3 is a top view of another drain fitting according to the invention.

In FIG. 3 there is shown a low profile drain fitting or drain shoe (300) comprising a plug assembly (301) that is intended to fit in the outlet of a shower or bath.

Plug assembly (301) comprises a fitting (302) having a central hole (303) for receiving a pop-up drain plug (not shown).

Fitting (301) provides a circular inlet (304) for water to flow into when in use draining a shower or bath. Inlet (304) is in fluid communication with a tail piece (305) extending generally perpendicularly to the central axis of inlet (304). Tail piece (305) comprises a generally cylindrical body (306) terminating in an outlet (307) formed by a connector portion (308), used for connecting to a waste or sewer pipe in a conventional manner.

Figure 4:
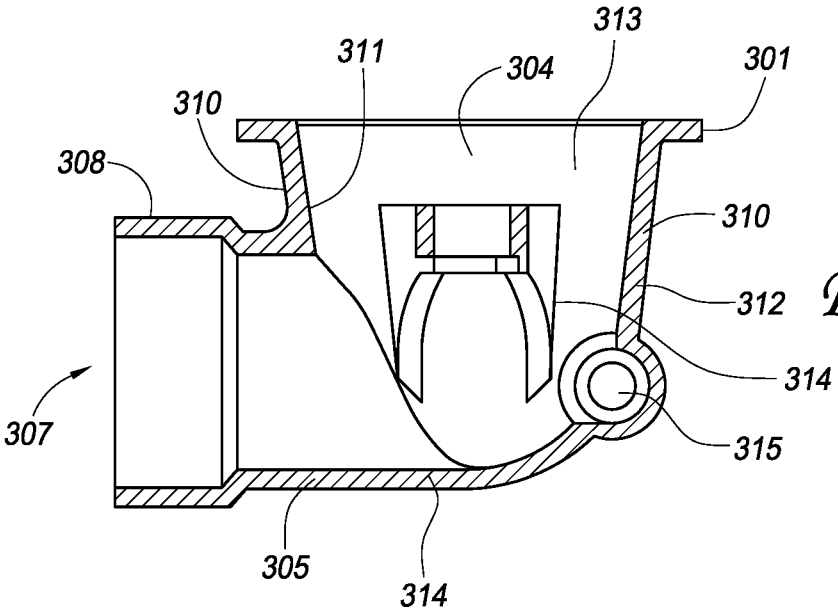
FIG. 4 is cross-sectional view of the drain fitting of FIG. 3 taken along the line 4-4 in the direction shown in FIG. 3.

The drain shoe in FIG. 3 further comprises a housing (309) for a cable mechanism (not shown) which can be used to open and close a pop-up closure (not shown). As can be seen in more detail in FIG. 4, fitting (301) comprises walls (310) that taper towards each other forming a generally frusto-conical shape that merges into the cylindrical body of the outflow connector (305). In order to make this embodiment a low profile drain shoe, wall (311) adjacent the outlet from the connector (305) is made relatively short and is substantially shorter than the opposing wall (312). Walls (311) and (312) form a chamber (313) which houses an assembly (314) for a pop-up valve (not shown). Adjacent the bottom wall (314) a connector portion there is provided a passageway (315) for receiving an actuator mechanism for the pop-up valve (not shown).

Figure 5:
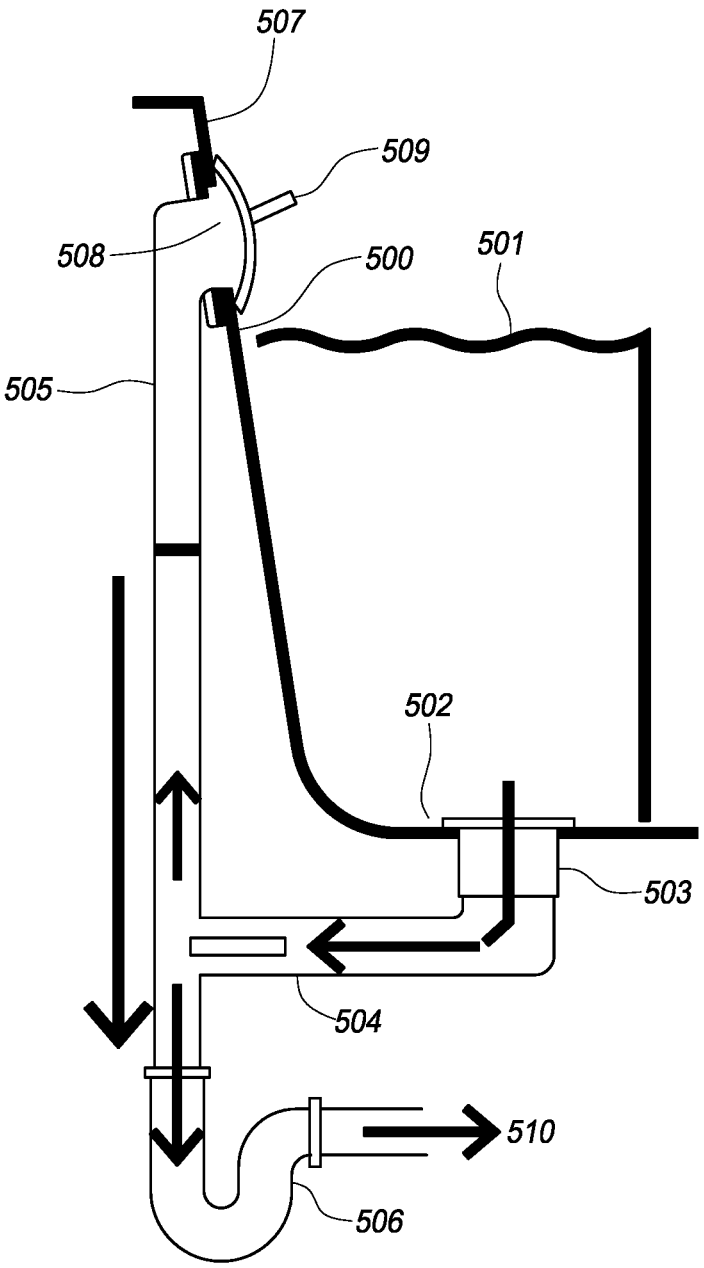
FIG. 5 is a schematic illustration of a bath draining through a drain shoe or drain fitting of this disclosure into a waste pipe and connected to a typical over flow pipe system.

Referring now to FIG. 5, there is shown a bath (500) containing water (501). The bath has an outlet (502) of which is connected to a drain fitting or drain shoe according to this disclosure (503).

A tail pipe (504) is connected to an overflow pipe (505) as well a pipe connection (506) to waste. Bath (500) has a wall (507) with a hole (508) receiving a conventional drain plug pop-up actuator (509).

When the Bath (500) is draining, the water in the bath produces a force on outgoing water. Similarly, water height in the overflow pipe (505) acts like a "water tower" and applies direct gravity force to the outgoing water in the drain pipe so that ultimately, for example at (510), the pipe system drains at full flow and gravity force and with preferably little or no trapped air and provide gravity pressure to accelerate the flow of the water into waste, such as a sewer pipe.

What is claimed is:

1. A drain fitting comprising:

a chamber comprising an inlet, an outlet, and a wall extending between the inlet and the outlet, the inlet having an inlet cross-sectional flow area that is greater than an outlet cross-sectional flow area of the outlet, wherein the wall comprises an interior surface that slopes toward a central axis of the chamber from the inlet to the outlet such that an inner periphery of the chamber decreases from the inlet to the outlet; and a connector portion comprising an annular wall and a connector outlet that is configured to connect to piping to direct fluid away from the drain fitting along a central axis of the connector portion, the connector portion connected to the chamber with the central axis of the connector portion being perpendicular to the central axis of the chamber, wherein the wall of the chamber merges with the annular wall of the connector portion and extends at least to a central longitudinal plane of the connector portion, wherein the central longitudinal plane extends along the central axis of the connector portion and is perpendicular to the central axis of the chamber.

2. The drain fitting of claim 1, further comprising a drain closure fitting extending across the inlet that is configured to receive a plug.

3. The drain fitting of claim 2, further comprising an actuator that is configured to move the plug to open and close the inlet.

4. The drain fitting of claim 3, further comprising a cable assembly that is configured to manipulate the actuator.

5. The drain fitting of claim 1, wherein the wall of the chamber has a shape that is generally that of a truncated cone.

6. The drain fitting of claim 1, wherein the inlet has a diameter that is greater than 1½ inches.

7. The drain fitting of claim 1, further comprising a flange that annularly surrounds the inlet and extends radially away from the central axis of the chamber, wherein the flange is configured to be supported by a surface of a bathing apparatus.

8. The drain fitting of claim 1, wherein a first cross-sectional flow area at the merger is larger than a second cross-sectional flow area through the connector portion.

9. A drain fitting comprising:

an inlet opening and an outlet opening, the inlet opening being larger than the outlet opening;

a wall extending from the inlet opening to the outlet opening, the wall comprising an inner surface forming a generally tapered section between the inlet opening and the outlet opening; and a connector portion connected to the wall, the connector portion comprising an annular wall forming a hollow body and a connector outlet that is configured to be connected to piping to direct fluid away from the drain fitting, the annular wall having a diameter perpendicular to a central axis of the connector portion, wherein the wall merges with the annular wall of the connector portion at least to opposing points on the annular wall such that the diameter of the connector portion extends between the opposing points and through the central axis of the connector portion, wherein the central axis of the connector portion is perpendicular to a central axis of the inlet opening, wherein the wall extends at least to a central longitudinal plane of the connector portion, and wherein the central longitudinal plane extends along the central axis of the connector portion and is perpendicular to the central axis of the inlet opening.

10. The drain fitting of claim 9, wherein the inlet opening has a diameter that is greater than 1½ inches.

11. The drain fitting of claim 9, further comprising a flange annularly surrounding the inlet opening and extending radially away from a central axis of the inlet opening, wherein a lower surface of the flange is configured to be supported by a surface of a bathing apparatus.

12. The drain fitting of claim 9, wherein the drain fitting is generally elbow-shaped.

13. The drain fitting of claim 9, wherein a first cross-sectional flow area at the merger is larger than a second cross-sectional flow area through the connector portion.

14. A drain fitting comprising:

a wall extending between an inlet and an outlet, the inlet being larger than the outlet, and wherein the wall comprises an interior surface that slopes inwardly between the inlet and the outlet such that an inner periphery decreases from the inlet to the outlet; and a connector portion comprising a tube, the connector portion comprising a connector outlet that is configured to be connected to piping to direct fluid away from the drain fitting along a central axis of the tube, wherein the wall merges with the tube of the connector portion such that a first cross-sectional flow area at the merger is larger than a second cross-sectional flow area through the tube, wherein the central axis of the tube extends through the first cross-sectional flow area, wherein the central axis of the tube is perpendicular to a central axis of the inlet, wherein the wall extends at least to a central longitudinal plane of the tube, and wherein the central longitudinal plane extends along the central axis of the tube and is perpendicular to the central axis of the inlet.

15. The drain fitting of claim 14, wherein the inlet has a diameter that is greater than 1½ inches.

16. The drain fitting of claim 14, further comprising a flange annularly surrounding the inlet and extending radially away from a central axis of the inlet, wherein a lower surface of the flange is configured to be supported by a surface of a bathing apparatus.

17. The drain fitting of claim 14, further comprising a drain closure fitting extending across the inlet that is configured to receive a plug.

18. A bath comprising the drain fitting of claim 14.

19. The bath of claim 18, further comprising an overflow pipe that is connected to the connector portion and is configured to connect to a waste fluid pipe, wherein the inlet, outlet, and wall are configured to cause fluid to fill the overflow pipe to a height approaching a height of fluid in the bath.

20. The bath of claim 18, wherein the bath comprises a door.

* * * * *